US012232604B2

(12) United States Patent
Noethe et al.

(10) Patent No.: US 12,232,604 B2
(45) Date of Patent: Feb. 25, 2025

(54) BRUSH HAVING A BRISTLE BUNCH FASTENED BY MEANS OF CLAMPS, AND WIRE FOR PRODUCING SUCH CLAMPS

(71) Applicant: BERKENHOFF GMBH, Heuchelheim (DE)

(72) Inventors: Tobias Noethe, Herborn (DE); Waldemar Schroeder, Giessen (DE)

(73) Assignee: BERKENHOFF GMBH, Heuchelheim (DE)

( * ) Notice: Subject to any disclaimer, the term of this patent is extended or adjusted under 35 U.S.C. 154(b) by 455 days.

(21) Appl. No.: 17/633,403

(22) PCT Filed: Jul. 13, 2020

(86) PCT No.: PCT/EP2020/069771
§ 371 (c)(1),
(2) Date: Feb. 7, 2022

(87) PCT Pub. No.: WO2021/028139
PCT Pub. Date: Feb. 18, 2021

(65) Prior Publication Data

US 2022/0287445 A1 Sep. 15, 2022

(30) Foreign Application Priority Data

Aug. 12, 2019 (DE) ..... 10 2019 121 693.1

(51) Int. Cl.
*A46B 3/16* (2006.01)
*A46B 9/04* (2006.01)

(52) U.S. Cl.
CPC ..... *A46B 3/16* (2013.01); *A46B 9/04* (2013.01); *A46B 2200/1066* (2013.01)

(58) Field of Classification Search
CPC ..... A46B 2200/1066; A46B 9/04; A46B 3/16
USPC ..... 15/206
See application file for complete search history.

(56) References Cited

U.S. PATENT DOCUMENTS 5,740,579 A * 4/1998 Fassler ..... A46B 3/16 15/190
2004/0177462 A1 9/2004 Brown
2011/0000040 A1 1/2011 Paciullo
2014/0325778 A1 11/2014 Chang

FOREIGN PATENT DOCUMENTS

CN 102469871 A 5/2012
EP 0953304 A2 11/1999
JP 2001309818 A * 11/2001

(Continued)

*Primary Examiner* — Katina N. Henson
(74) *Attorney, Agent, or Firm* — Dickinson Wright PLLC; Andrew D. Dorisio

(57) ABSTRACT

The invention relates to a brush comprising a support made of a plastically deformable plastic material for disposing bristle clusters (13) thereon, the support having a plurality of cluster holes (14) each serving to accommodate one bristle cluster (13), the bristle clusters (13) each being fixed in a cluster hole (14) by means of a clip (16), and the clips (16) being provided with discontinuous structural elements at least in the area of clip projections (23, 24) on at least one longitudinal side (22) disposed essentially parallel to a cluster hole axis, wherein the structural elements are disposed at a distance to the longitudinal edges of the clip (16).

14 Claims, 5 Drawing Sheets

(56) References Cited

FOREIGN PATENT DOCUMENTS

| | | | |
|---|---|---|---|
| JP | 2004081286 | A | 3/2004 |
| JP | 2018114063 | A | 7/2018 |
| MY | 156022 | A | 12/2015 |
| WO | 9746136 | A1 | 12/1997 |
| WO | 9800048 | A1 | 1/1998 |
| WO | 9805238 | A1 | 2/1998 |
| WO | 2006115963 | A2 | 11/2006 |
| WO | 2020135915 | A1 | 7/2020 |
| WO | 2021078948 | A1 | 4/2021 |

* cited by examiner

BRUSH HAVING A BRISTLE BUNCH FASTENED BY MEANS OF CLAMPS, AND WIRE FOR PRODUCING SUCH CLAMPS

TECHNICAL FIELD

The present invention relates to a brush comprising a support made of a plastically deformable plastic material for disposing bristle clusters thereon, the support having a plurality of cluster holes each serving to accommodate a bristle cluster, the bristle clusters each being fixed in one cluster hole by means of a clip, the clips having a length greater than the diameter of the cluster hole so as to form clip projections formed on both longitudinal ends, and the clips being provided with structural elements at least in the area of the projections on at least one longitudinal side disposed essentially parallel to a cluster hole axis, the structural elements being discontinuous in the longitudinal direction of the clip, the clip projections provided with the structural elements being pressed into and thereby embedded in the plastic material of the support so as to fix the bristle clusters. Furthermore, the invention relates to a wire for forming clips for such a brush.

BACKGROUND

Brushes are known in different embodiments and for various uses. Irrespective of the embodiment and the intended use, brushes have cluster holes for disposing bristle clusters therein, the bristle clusters being fixed in said cluster holes. Tooth brushes in particular are known for having the bristle clusters disposed in cluster holes which are formed in a support made of a plastically deformable plastic material. The bristle clusters are fixed in the cluster holes by means of a wire clip, which has a length greater than the diameter of the cluster hole so as to form clip projections and whose clip projections formed at its longitudinal ends are pressed into the material of the support with the result that the bristle clusters are fixed in the support in a force-fitting and form-fitting manner by means of the clip which extends through the brush hole.

For anchoring the clip projections in the material of the support, it is known for opposite side surfaces of the clip, which is made of a metal wire, to be provided with structural elements in such a manner that an anchoring is established between the structural elements formed on the clip projections and the material of the support as a result of the material displacement in conjunction with a flowing of the material caused by the material displacement when the clip projections are pressed into the material. The anchoring results in an improved fixation of the bristle clusters in the support, which is reflected in an increase in the pulling forces required to sever the connection between the clip and the material of the support by means of a pulling movement taking place opposite to the pressing-in direction.

A first development which enables the increase in the pulling forces discussed above has been described in WO 97/46136 A1, in which a wire is described for producing the clips, said wire being provided with multiple parallel grooves on two opposite longitudinal sides, said grooves extending continuously in the longitudinal direction of the wire.

Based on the state of the art indicated by WO 97/46136 A1, it has been possible to achieve an increase in the pulling force by forming structural elements, which form a diamond pattern on the longitudinal sides as in WO 98/05238, in a discontinuous manner on the longitudinal sides of the clip, the structural elements, which have appropriately sharp edges, being produced by an intersecting layout of diagonal surface grooves.

Apart from the fact that the production of the known diamond-like structure presumes a correspondingly complex surface processing of the longitudinal sides of the clips, it has proven disadvantageous that the known surface structure with the crystal-like material protrusions of the clips resulting from the intersecting arrangement of the diagonal grooves extends into the longitudinal edges of the clip with the result that in particular the clip edge which strikes the support material when the clips are pressed in does not have an even thickness but rather thickened portions which are formed by the material protrusions and which lead to an increase in the pressing forces. The increased pressing forces necessitate a dimensioning that prevents buckling and therefore an increased material input for the clip in order to prevent buckling and therefore component failure during the pressing process. Both the increased pressing forces and the increased material input lead to an increase in production costs.

SUMMARY

The object of the present invention is to propose a brush of the kind mentioned above which enables a more cost-efficient production.

To attain this object, the brush according to the invention has the features of claim 1.

The structural elements of the brush according to the invention are disposed at a distance to the longitudinal edges of the clip with the result that a continuous cutting edge can be formed on the longitudinal edges of the clip, said continuous cutting edge facilitating pressing the clip projections into the material of the support to embed them therein with the result that smaller pressing forces are required when producing the brush. This reduces in particular the energy input required for producing the brush and therefore the proportion of the production costs in brush production. Moreover, the reduction in the pressing forces allows a correspondingly reduced dimensioning of the clips with the result that the reduced material input can also reduce the production costs of the brush.

The advantageous effect of the invention still occurs even if individual structural elements do not have an edge distance as long as the majority of the structural elements is disposed at a distance to the longitudinal edges of the clip.

The structural elements of the brush according to the invention can be formed both as a peak or a valley relative to a flat base surface of the longitudinal side.

In particular if the structural elements have both a valley and a peak relative to a flat base surface of the longitudinal side according to a particularly preferred embodiment, an increase in the pulling force can be achieved compared to a design of the structural elements where each structural element is entirely a peak or a valley relative to a flat base surface.

This increase in the pulling force can in particular also be achieved if the structural elements extend into the longitudinal edges of the clip with the result that the advantageous effect of an increase in the pulling forces can be achieved even irrespective of whether the structural elements are disposed at a distance to the longitudinal edges of the clip.

Particularly preferably, the valley surrounds the peak at least partially with the result that the ideally concentric arrangement of the valley and the peak of one and the same structural element results in a particularly effective anchoring, the peak forming a material protrusion relative to the valley, only a part of said material protrusion, namely the projection of the peak beyond the flat base surface, leading to an increase in the thickness of the clip which has an effect on the magnitude of the pressing force.

This advantageous effect becomes especially effective if the peak is surrounded by the valley in the manner of a moat.

Preferably, the clip projections formed on the clip each have a structural element matrix comprising at least two structural elements disposed in a matrix column, which ensures that the advantageous effect of discontinuous structural elements can be achieved multiple times in the clip projections.

If the distance between two structural elements disposed in the matrix column is dimensioned in such a manner that a structural element disposed in an adjacent matrix column protrudes at least partially into a space formed by the distance, the structural elements can be disposed in a particularly effective manner.

Preferably, more than 50% of the longitudinal side of the clip is covered by the structural elements in the area of the clip projections.

A configuration of the brush that can be reproduced particularly well in terms of the anchoring effect, i.e., the magnitude of the pulling force, is made possible if the structural elements are designed alike.

The wire according to the invention, which enables cost-efficient production of the brush, has the features of claim 11.

According to the invention, the structural elements are disposed at a distance to the longitudinal edges.

Preferably, the structural elements are peaks or valleys relative to a flat base surface of the longitudinal side.

Particularly preferably, the structural elements are disposed on the flat base surface of the longitudinal side and have both a valley and a peak relative to the base surface, the thus achieved advantageous effect of an alternating anchoring of a clip designed in such a manner, embedded in the material of the support of a brush and produced from the wire according to the invention by cutting to length can also be achieved irrespective of whether the structural elements are disposed at a distance to the longitudinal edges of the clip.

Particularly advantageously, the valley at least partially surrounds the peak.

Particularly preferably, the peak is surrounded by the valley in the manner of a moat.

Preferably, the structural elements are disposed in a structural matrix, the distance between two structural elements disposed in a matrix column being dimensioned in such a manner that a structural element disposed in an adjacent matrix column protrudes at least partially into a space formed by the distance with the result that a particularly high density of the structural elements is made possible.

Preferably, the structural elements are designed alike, the structural elements particularly preferably being distributed across the entire longitudinal side with the result that clips for fixing bristle clusters and supports of a brush can be produced by cutting portions of the wire to length at any point of the wire.

Particularly preferably, the structural elements in matrix columns and matrix rows of the structural matrix are disposed at regular intervals.

Furthermore, it is particularly preferred for more than 50% of the longitudinal side of the wire to be covered by the structural elements.

Hereinafter, the invention will be discussed in more detail with reference to the preferred embodiments illustrated in the drawing.

DETAILED DESCRIPTION

Figure 1:
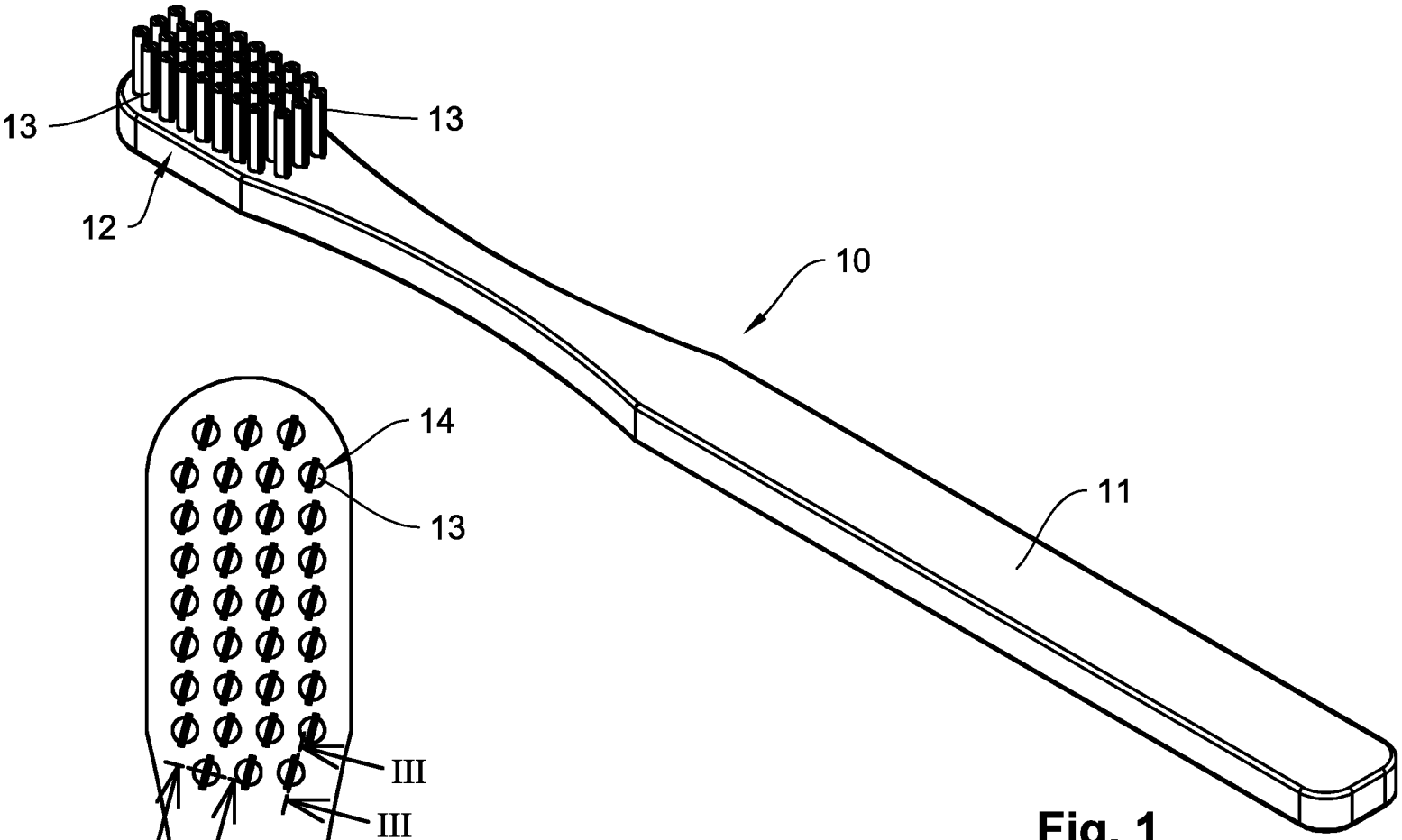
FIG. 1: is an isometric illustration of a toothbrush.
Figure 2:
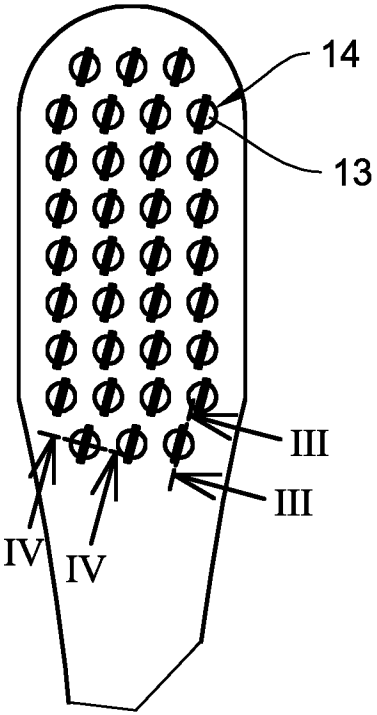
FIG. 2: is an enlarged illustration of a brush head of the toothbrush illustrated in FIG. 1 from the top.

FIG. 1 shows a toothbrush 10 having a brush head on one end of a toothbrush body opposite a handle 11, the brush head serving as a support 12 for a plurality of bristle clusters 13. At least the brush head, which is support 12, is made of a plastically deformable plastic material and has a number of cluster holes 14 corresponding to the number of bristle clusters 12, as is shown in FIG. 2 in particular; bristle clusters 13, which are each composed of a plurality of essentially parallel bristles or filaments, are inserted into and fixed in said cluster holes 14, as shown in FIGS. 3 and 4 in particular.

Figure 9:
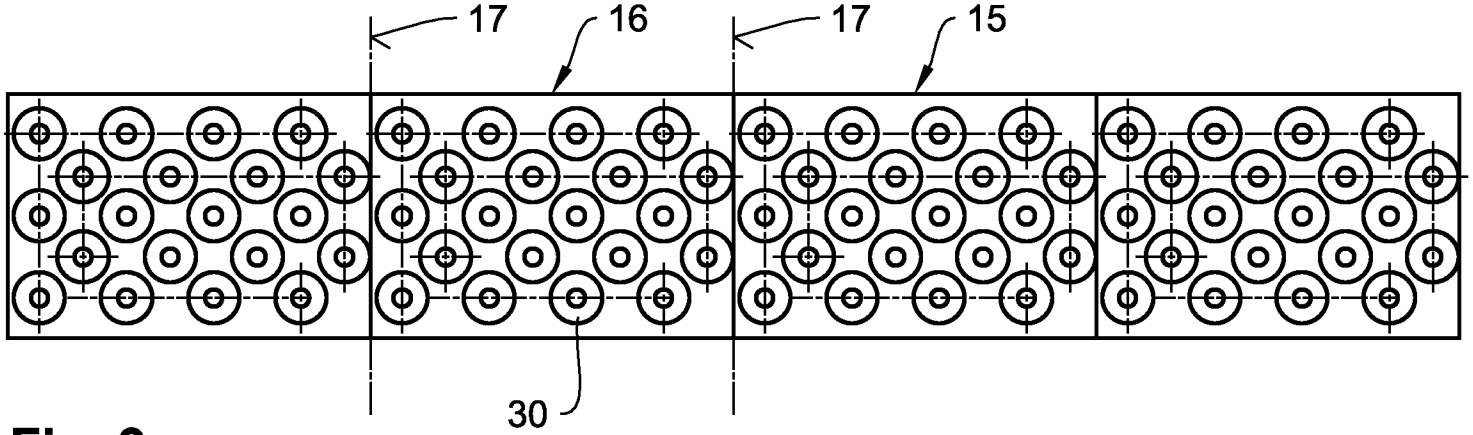
FIG. 9: shows a clip wire for producing the clip illustrated in FIGS. 2 to 8.

A clip 16 formed by a trimmed portion of a wire 14 illustrated in FIG. 9 serves to fix a bristle cluster 13 in a cluster hole 14, clip 16 being separated from wire 15 as indicated by means of separating line 17 in FIG. 9.

Figure 4:
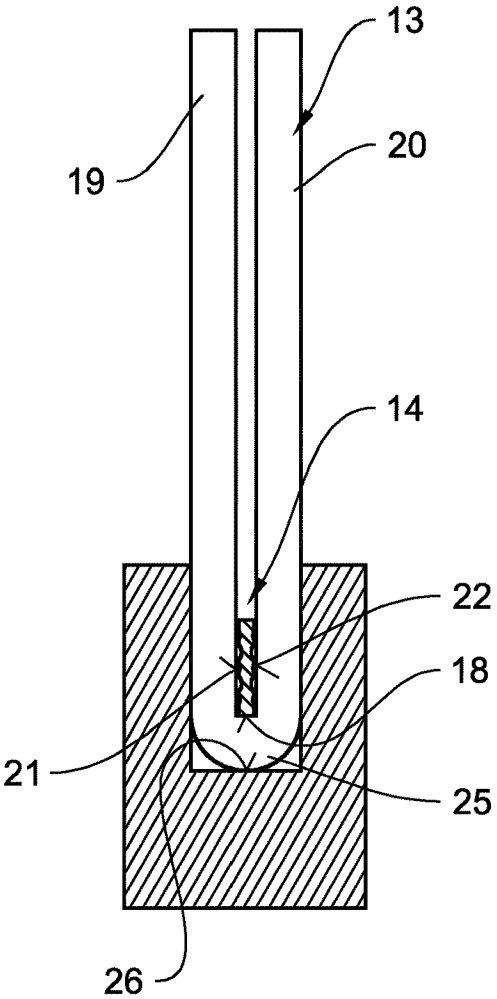
FIG. 4: is an enlarged illustration and a sectional illustration according to line IV-IV in FIG. 2 showing a bristle cluster inserted into a cluster hole of the brush head illustrated in FIG. 2.
Figure 3:
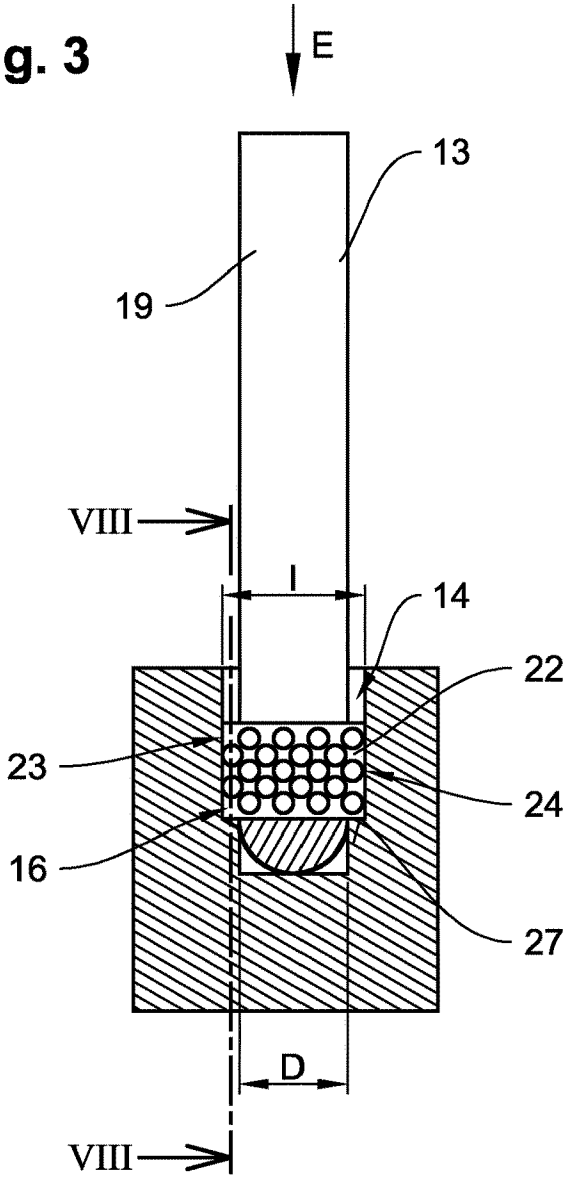
FIG. 3: is an enlarged illustration and a sectional illustration along line III-III in FIG. 2 showing a bristle cluster fixed in a cluster hole of the brush head illustrated in FIG. 2.

As can be understood from a combination of FIGS. 3 and 4, the bristle cluster 13 is fixed in cluster hole 14 by wrapping bristle cluster 13, which is originally a straight bristle strand, around a lower longitudinal edge 18 of clip 16 in such a manner that two opposite cluster legs 19, 20 come into contact with two opposite longitudinal sides 21, 22 of clip 16, and clip 16, which has a clip length l greater than diameter D of cluster hole 14, is inserted into cluster hole 14 with a pressing force E delineated in FIG. 3, clip projections 23, 24 formed because of greater length l of clip 16 compared to diameter D being pressed into plastic material 15 of support 12 limiting cluster hole 14 until a cluster base 25 being in contact with lower longitudinal edge 18 of clip 16 comes into contact with a bottom 26 of cluster hole 14.

Figure 8:
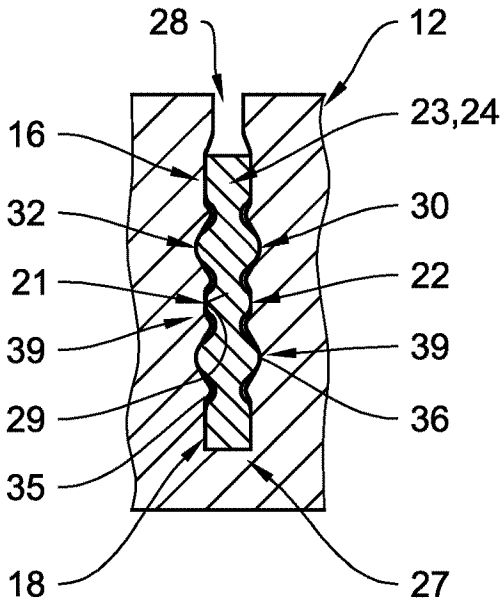
FIG. 8: is a cross-sectional illustration along line VIII-VIII in FIG. 3 showing a clip projection formed on the clip illustrated in FIG. 3.

As made clear by FIG. 8 in particular, the pressing process causes clip projections 23, 24 to form a cut 28 in plastic material 25 of support 12 according to the path traveled by clip projections 23, 24 in the plastic material of support 12, lower longitudinal edge 18 forming a cutting edge 27 and the plastic material being displaced by clip projections 23, 24. The plastic deformability of the plastic material causes the displaced plastic material to flow in the area of clip projections 23, 24, cutting flanks 29 formed by cut 28 shaping themselves to longitudinal sides 21, 22 of clip 16, which are provided with structural elements 30.

Figure 5:
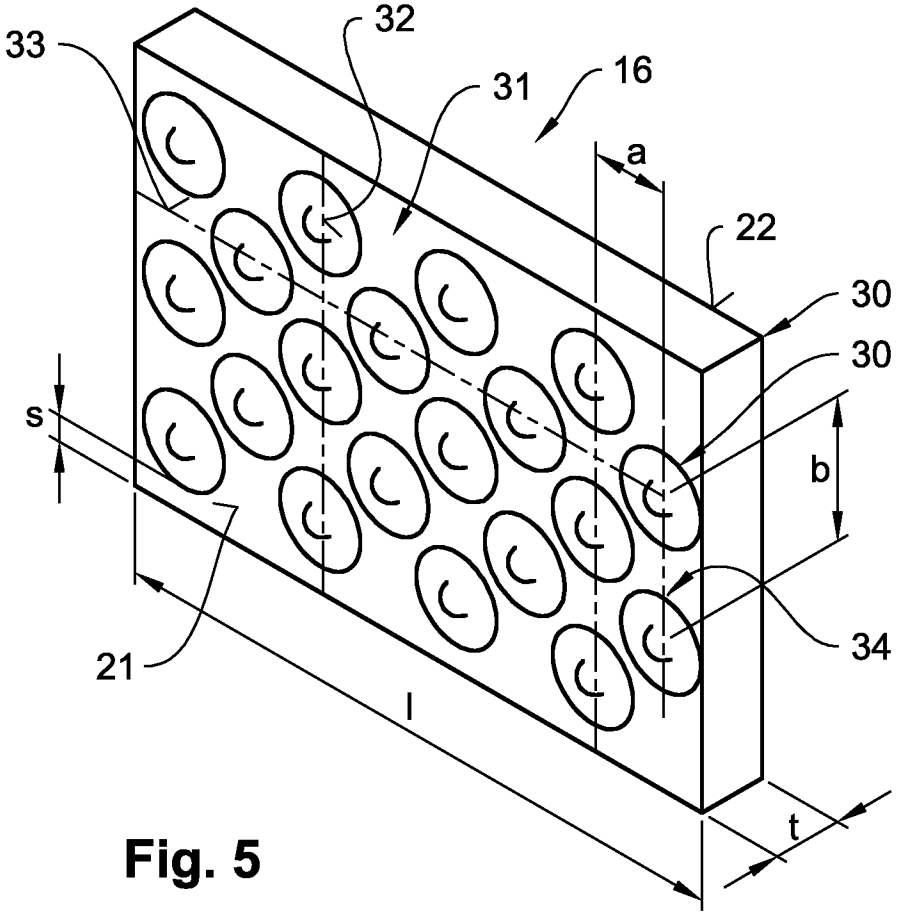
FIG. 5: is an isometric illustration of a clip for fixing the bristle cluster illustrated in FIGS. 3 and 4.
Figure 7:
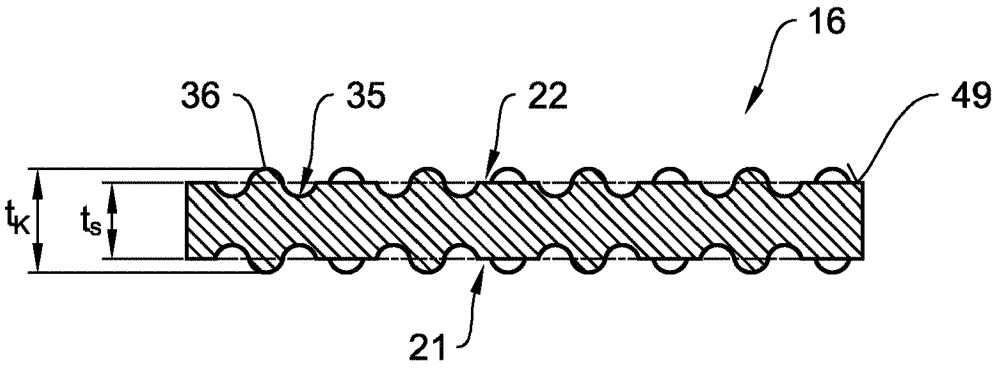
FIG. 7: is a sectional illustration along line VII-VII in FIG. 6 showing the clip illustrated in FIG. 6.
Figure 6:
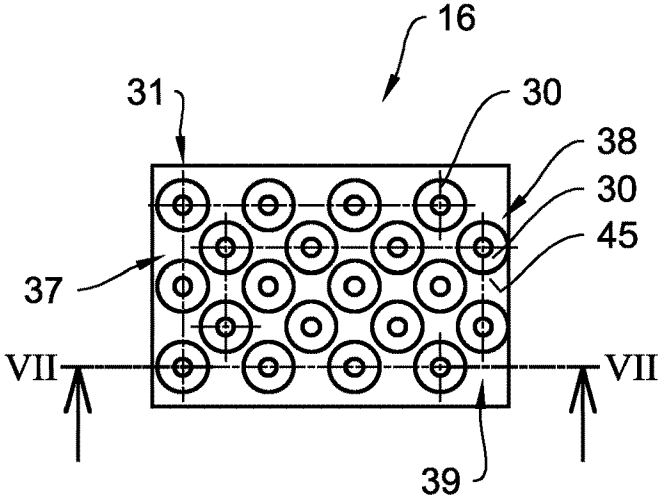
FIG. 6: is a top view of the clip illustrated in FIG. 5.

As can be seen from a combination of FIGS. 5, 6 and 7 in particular, opposite longitudinal sides 21, 22 are provided with structural elements 30 in such a manner that a structural element matrix 31 comprising two structural elements 30 disposed in a matrix column 32 and a structural element matrix 39 comprising three structural elements 30 disposed in a matrix column 32 are formed in particular on longitudinal ends 37, 38 of clip 16, which form clip projections 23, 24 during the pressing process described with reference to FIGS. 3 and 4. In the embodiment of clip 16 illustrated in FIG. 5, structural elements 30 are moreover distributed across entire longitudinal sides 21, 22, structural elements 30 in matrix columns 32 and in matrix rows 33 being disposed at regular intervals. Moreover, distance a between adjacent matrix columns 32 is dimensioned in such a manner that a structural element 30 disposed in an adjacent matrix column 32 at least partially protrudes into a space 34 formed by distance b of the structural elements within a matrix column 32.

As becomes clear from a combination of FIGS. 6 and 7 in particular, the longitudinal sides of clip 16 each have a flat base surface 50 on which structural elements 30 are disposed, each structural element 30 having both a valley 35 and a peak 36 relative to base surface 34. In the case of the exemplary embodiment illustrated at hand, peak 36 is moreover surrounded by valley 35 in the manner of a moat.

As shown in FIG. 8, the flowing behavior of the plastic material in conjunction with structural element matrix 39 formed in the area of clip protrusion 23 and comprising structural elements 30 disposed in a matrix column 32 on each longitudinal side 21, 22 results in a toothed engagement between clip protrusion 23 and the adjacent plastic material of support 12, such that plastic material 25 protrudes into valleys 35 of structural elements 30 and peaks 36 of structural elements 30 protrude into plastic material 25 of support 12. This alternating engagement between clip protrusion 23 and the plastic material of the support results in a particularly durable connection between clip 16 and support 12, which can only be severed by particularly high pulling forces.

As can be seen from FIG. 7 in particular, structural elements 30 are disposed at a distance s to lower longitudinal edge 18, which—as explained above—forms a cutting edge 27, cutting edge 27 consequently having a lesser edge thickness is than the greater width $t_K$ of clip 16 due to projection h of peaks 36 relative to base surface 34. As a result, comparatively smaller pressing forces have to be exerted at the beginning of the pressing process described above than if the structural elements were disposed without a distance to lower longitudinal edge 18 with the result that the thickness of cutting edge 37 formed on lower longitudinal edge 18 would correspond to the width of clip 16.

Figure 10:
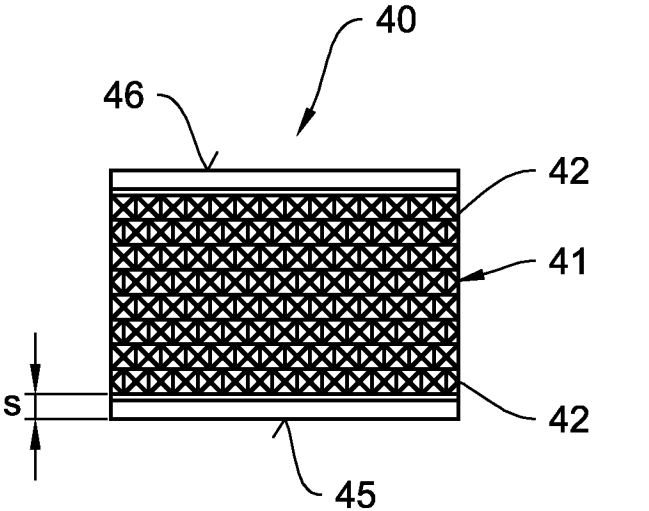
FIG. 10: is a top view of another embodiment of a clip.
Figure 11:
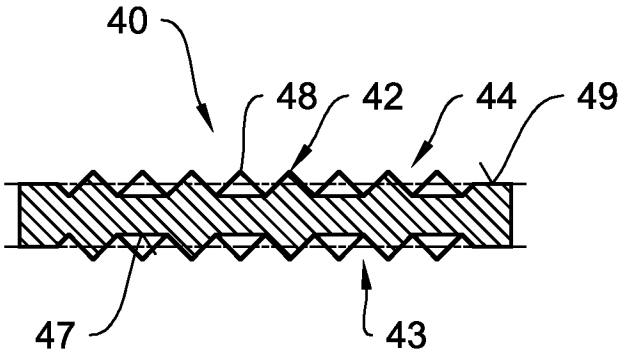
FIG. 11: is a cross-sectional illustration along line XI-XI in FIG. 10 showing the clip illustrated in FIG. 10.

FIGS. 10 and 11 show another embodiment, in which a clip 40 is provided with structural elements 42, which are disposed in a matrix arrangement 41, on opposite longitudinal sides 43, 44, a distance s being formed between structural elements 42 and longitudinal edges 45, 46 in further correspondence with clip 16.

Structural elements 42 have a valley 47 and a peak 48 relative to a base surface 49, peak 48 having the shape of a pyramid in the case at hand.

Both structural elements 30 on longitudinal sides 21, 22 of wire 15, which is illustrated in FIG. 9 and serves to produce clips 16, and structural elements 42 on longitudinal sides 43, 44 of a wire serving to produce clips 40 can be produced by simple rolling, where a wire provided with a smooth surface on the longitudinal sides is passed through a roll gap formed between two embossing rolls.

The invention claimed is:

1. A brush comprising a support (12) made of a plastically deformable plastic material for disposing bristle clusters (13) thereon, the support (12) having a plurality of cluster holes (14) each serving to accommodate one bristle cluster (13), the bristle clusters (13) each being fixed in a cluster hole (14) by means of clips (16, 40) having a length l greater than a diameter D of the cluster hole (14) so as to form clip projections (23, 24) formed on both longitudinal ends (37, 38), and the clips (16, 40) being provided with discontinuous structural elements (30, 42) at least in an area of the clip projections (23, 24) on at least one longitudinal side (21, 22; 43, 44) disposed essentially parallel to a cluster hole axis, the clip projections (23, 24) provided with the structural elements (30, 42) being pressed into and thereby embedded in the plastic material of the support (12) so as to fix the bristle clusters (13), wherein the structural elements (30, 42) are disposed at a distance to the longitudinal edges (18, 46, 47) of the clips (16, 40), wherein the structural elements (30, 42) have both a valley (35, 47) and a peak (36, 48) relative to a base surface (50, 49) of the longitudinal side (21, 22; 43, 44), wherein the valley (35, 47) at least partially surrounds the peak (36, 48).

2. The brush according to claim 1, wherein the peak (36, 48) is surrounded by the valley (35, 47) in the manner of a moat.

3. The brush according to claim 1, wherein the clip projections (23, 24) formed on the clip (16, 40) each have a structural element matrix (31, 39) comprising at least two structural elements (30, 42) disposed in a matrix column (32).

4. The brush according to claim 3, wherein the structural elements (30) have a length in the longitudinal direction of the clip (16) which is less than the length of the clip projections (23, 24).

5. The brush according to claim 3, wherein a distance b between two structural elements (30) disposed in the matrix column (32) is dimensioned in such a manner that a structural element (30) disposed in an adjacent matrix column (32) protrudes at least partially into a space (34) formed by distance b.

6. The brush according to claim 1, wherein more than 50% of the longitudinal side (21, 22) of the clip (16) is covered by the structural elements (30) in the area of the clip projections (23, 24).

7. The brush according to claim 1, wherein the structural elements (30, 42) are designed alike.

8. A wire (15) for forming clips (16) for a brush according to claim 1, the wire (15) having structural elements (30) on at least one of two opposite longitudinal sides (21, 22) which extend between two longitudinal edges (18) of the wire, wherein the structural elements (30) are disposed at a distance to the longitudinal edges (18) of the wire (15), wherein the structural elements have both a valley (35) and a peak (36) relative to the base surface (50), and wherein the valley (35) at least partially surrounds the peak (36).

9. The wire according to claim 8, wherein the peak (36) is surrounded by the valley (35) in the manner of a moat.

10. The wire according to claim 8 wherein the structural elements (30) are disposed in a structural element matrix (31), distance b between two structural elements (30) disposed in a matrix column (32) being dimensioned in such a manner that a structural element (30) disposed in an adjacent matrix column (32) protrudes at least partially into a space (34) formed by a distance b.

11. The wire according to claim 8, wherein the structural elements (30) are designed alike.

12. The wire according to claim 8, wherein the structural elements (30) are distributed across an entire length of the longitudinal sides (21, 22).

13. The wire according to claim 10, wherein the structural elements (30) are disposed at regular intervals in matrix columns (32) and matrix rows (33) of the structural element matrix (31).

14. The wire according to claim 1, wherein more than 50% of the longitudinal side (21, 22) of the wire (15) is covered by the structural elements (30).

* * * * *